US005692954A

United States Patent [19]

Lee et al.

[11] Patent Number: 5,692,954

[45] Date of Patent: Dec. 2, 1997

[54] AIR-SHOWER SYSTEM FOR A CLEAN ROOM

[75] Inventors: Joung Sun Lee, Kyungki-do; Je Ku Park, Pusan; Je Kang Jun; Sang Bong Choi, both of Kyungki-do, all of Rep. of Korea

[73] Assignee: Samsung Electronics Co., Ltd., Suwon, Rep. of Korea

[21] Appl. No.: 434,005

[22] Filed: May 3, 1995

[30] Foreign Application Priority Data

May 9, 1994 [KR] Rep. of Korea ..... 94-10115

[51] Int. Cl.[6] ..... F24F 3/16

[52] U.S. Cl. ..... 454/187; 55/385.2

[58] Field of Search ..... 454/187, 228, 454/229; 55/385.2, 467, 471, 473

[56] References Cited

U.S. PATENT DOCUMENTS

| | | | |
|---|---|---|---|
| 3,023,689 | 3/1962 | Kurek | 454/191 |
| 3,170,385 | 2/1965 | Tompkins et al. | 454/191 |
| 4,315,456 | 2/1982 | Hayashi et al. | 454/191 |

FOREIGN PATENT DOCUMENTS

| | | | |
|---|---|---|---|
| 61-1941 | 1/1986 | Japan | 454/187 |
| 61-59131 | 3/1986 | Japan | 454/187 |
| 63-148041 | 6/1988 | Japan | 454/187 |
| 1-212849 | 8/1989 | Japan | 454/187 |
| 3-263534 | 11/1991 | Japan | 454/187 |
| 4-186043 | 7/1992 | Japan | 454/187 |
| 5-99464 | 4/1993 | Japan | 454/187 |

*Primary Examiner*—Harold Joyce

*Attorney, Agent, or Firm*—Cushman Darby & Cushman, IP Group Of Pillsbury Madison & Sutro LLP

[57] ABSTRACT

An air shower system which includes an air shower room, an underground region in fluid communication with a clean room, an air supply chamber surrounding the sidewalls and ceiling of the air shower room, the air supply chamber having an intake portion in fluid communication with the underground region, a plurality of air supply nozzles provided in the sidewalls and ceiling of the air shower room, a plurality of air discharge holes provided in the floor of the air shower room, the air discharge holes being in fluid communication with the underground region, a plurality of filters provided in side portions of the air supply chamber disposed alongside the sidewalls of the air shower room, and, a plurality of blowers provided in the side portions of the air supply chamber for forcing air from the underground region through the filters and thence, through the air supply nozzles, into the interior of the air shower room, for blowing particulate matter off of a person situated in the interior of the shower room, the air containing the particulate matter being discharged through the air discharge holes into the underground region.

20 Claims, 5 Drawing Sheets

AIR-SHOWER SYSTEM FOR A CLEAN ROOM

BACKGROUND OF THE INVENTION

The present invention relates to an air-shower system for a clean room, such as are used in processes sensitive to even microscopic particlute matter, e.g., semiconductor device fabrication, food, medicinal, pharmaceutical, and biotech processes.

Clean rooms are building areas in which the temperature, humidity, dust, gas fumes, and other contaminant matter levels (and sometimes other environmental parameters) are strictly controlled and precisely maintained to exacting standards. In semiconductor fabrication clean rooms, the air is commonly filtered to remove airborne particulate matter. In very large scale integration (VLSI) semiconductor processing facilities, the clean room air must be filtered down to class 10 at a maximum particle size of 0.3 microns. Particulate quantity levels are measured in the air stream in the various process stations. The "class number" is the number of particulates per cubic foot per minute in the clean room air stream. In this connection, prior to entering clean rooms, personnel are generally required to change into a special, non-shedding, non-static clean room gown, and to wear a facial mask, shoe coverings, gloves, and a hood. Further, prior to entering clean rooms, personnel are generally subjected to an air shower to dislodge loose particulates that they may be carrying.

With reference now to FIG. 1, a conventional air shower system will now be described. The conventional air shower system includes a hexagonal air shower room 1 having a ceiling 2 provided with a hepa (high efficiency particulate air) filtering system, opposed side walls 3, 3' provided with a plurality of holes, and a grated floor 4 provided with a pre-filtering system (not shown). An air chamber 5 is provided around the outside surfaces of the floor 4, side wall 3', the ceiling 2, and an upper portion of the other side wall 3. Air is pulled into the air shower room 1 through an external air intake manifold 7, via an air inlet tube 8 fitted with a hepa filter (not shown), by a plurality of motor-driven blowers 6 disposed along the bottom wall of the portion of the air chamber 5 located outside the side wall 3' of the air shower room 1. Air is exhausted or discharged from the portion of the air chamber 5 beneath the floor 4 through an external air exhaust tube 9 fitted with an air filter (not shown). The external air intake manifold 7 is disposed between the upper portion of the air chamber 5 and the ceiling 2, which is also provided with a plurality of holes (not shown) or other suitable air egress means (not shown).

In operation, air entering the air intake manifold 7 through the air inlet tube 8 is filtered by the hepa filtering system in the ceiling 2 prior to being pulled into the interior of the air shower room 1 through the holes provided in the ceiling 2 by virtue of the pull (negative pressure) produced by the motor-driven blowers 6. More particularly, the motor-driven blowers 6 pull air (including the air entering via the ceiling 2) from the interior of the air shower room 1 through the grated floor 4 and into the portion of the air chamber 5 disposed beneath the floor 4. Prior to entering the portion of the air chamber 5 disposed beneath the floor 4, the air is filtered by the pre-filtering system provided in the floor 4. A portion of the air pulled into the portion of the air chamber 5 disposed beneath the floor 4 exits through the external air exhaust tube 9, and the remainder is pulled by the blowers 6 upwardly through the portion of the air chamber 5 disposed outside the side wall 3', where the air is again filtered by a filter(s) 10 disposed within that portion of the air chamber 5. A portion of the air in the portion of the air chamber 5 disposed outside the side wall 3' is then forced by the blowers 6 through the holes 11 provided in the side wall 3' into the interior of the air shower room 1, and the remainder is forced through the upper portion of the air chamber 5 disposed above the ceiling 2, and the portion of the air chamber 5 disposed outside the upper portion of the side wall 3, and finally, through the holes 11 provided in the other side wall 3, into the interior of the air shower room 1. The air thus entering the air shower room 1 through the holes 11 provided in the side walls 3, 3' is then pulled through the grated floor 4 into the portion of the air chamber 5 disposed beneath the floor 4, and partially recirculated and partially exhausted, in the manner described previously. The air blown into the interior of the air shower room 1 through the holes 11 provided in the side walls 3, 3' and the holes (not shown) in the ceiling 2 serves to dislodge loose particulate matter from any personnel (not shown) present in the air shower room 1.

The above-described conventional air shower system suffers from the following drawbacks and shortcomings. First, the large number of filters used in the many different parts of the system, i.e., in the ceiling, floor, side walls, air chamber, and air inlet and exhaust tubes, unduly complicates and reduces the efficiency of the system.

Second, the air shower room is functionally separate from the clean room, thereby necessitating a separate, additional air conditioning system for regulating the temperature, air flow rate, humidity, pressure, and other parameters of the air supplied to the air shower room, thereby unduly complicating and increasing the energy consumption, cost, and efficiency of the system.

Third, air is supplied to the interior of the air shower room only through a unidirectional air intake tube and then continuously recirculated, thereby resulting in the formation of air eddies in the upper portion of the air shower room proximate the air intake tube, thereby degrading the performance of the system, i.e., the air filtering capability of the system.

Fourth, the upper right-angle corners of the air shower room cause turbulent air flow, thus further degrading the air filtering capability of the system.

Fifth, the particulate matter removed by the pre-filtering system provided in the grated floor of the air shower room can fly back into the interior of the air shower room, thereby further degrading the functionality and performance of the system.

Based on the above and foregoing, it can be appreciated that there presently exists a need in the art for an air shower system for a clean room which eliminates the above-described drawbacks and shortcomings of the presently available air shower systems. The present invention fulfills this need.

SUMMARY OF THE INVENTION

The present invention encompasses an air shower system which includes an air shower room, an underground region in fluid communication with a clean room, an air supply chamber surrounding the sidewalls and ceiling of the air shower room, the air supply chamber having an intake portion in fluid communication with the underground region, a plurality of air supply nozzles provided in the sidewalls and ceiling of the air shower room, a plurality of air discharge holes provided in the floor of the air shower room, the air discharge holes being in fluid communication with the underground region, a plurality of filters provided in side portions of the air supply chamber disposed alongside the sidewalls of the air shower room, and, a plurality of blowers provided in the side portions of the air supply chamber for forcing air from the underground region through the filters and thence, through the air supply nozzles, into the interior of the air shower room, for blowing particulate matter off of a person situated in the interior of the shower room, the air containing the particulate matter being discharged through the air discharge holes into the underground region.

BRIEF DESCRIPTION OF THE DRAWINGS

These and various other features and advantages of the present invention will be readily understood with reference to the following detailed description taken in conjunction with the accompanying drawings, wherein like reference numerals designate like structural elements, and, in which.

DETAILED DESCRIPTION OF THE INVENTION

Figure 1:
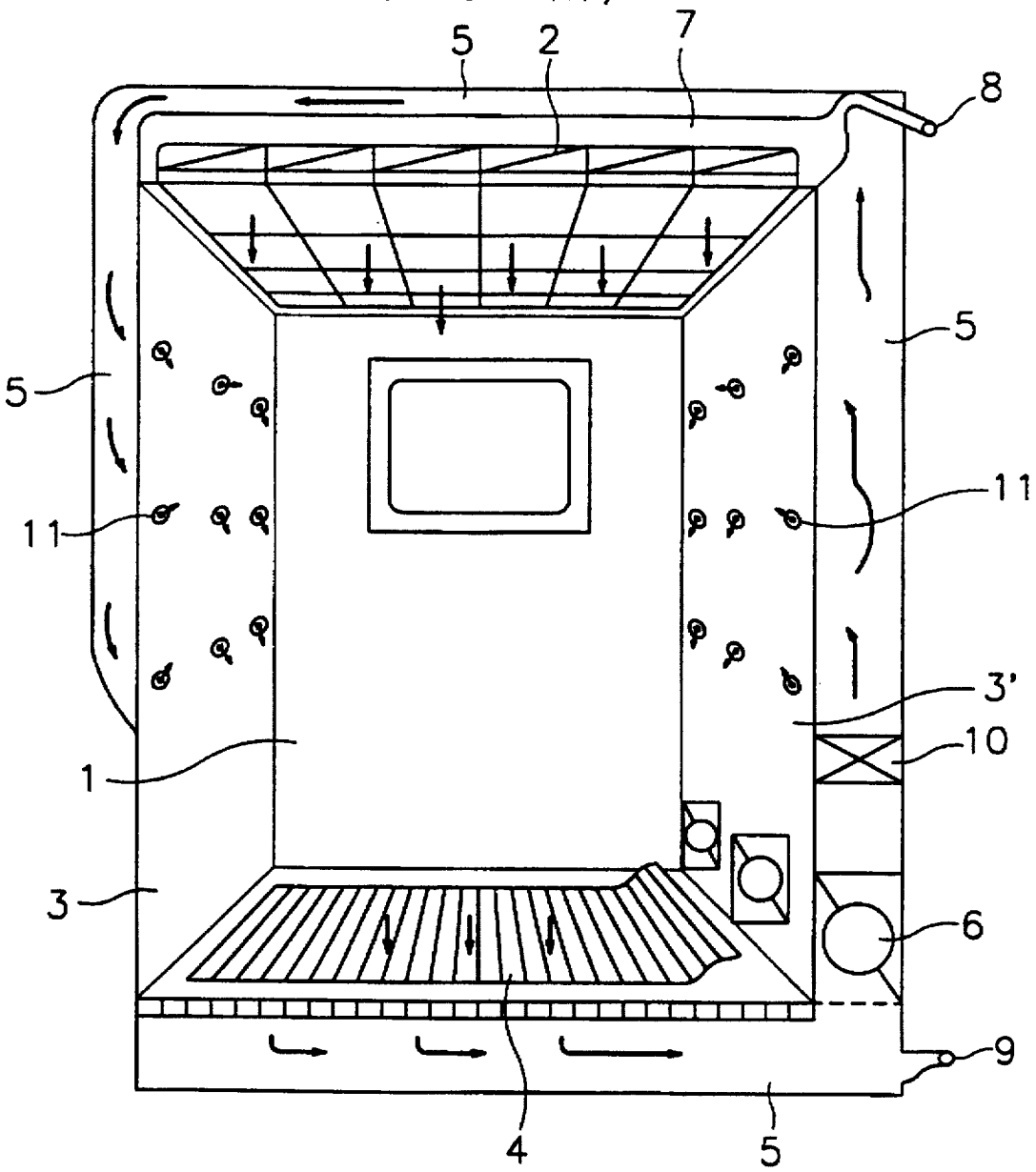
FIG. 1 (PRIOR ART)
FIG. 1 is a schematic, perspective view of the internal structure of a conventional air shower system.
Figure 2A:
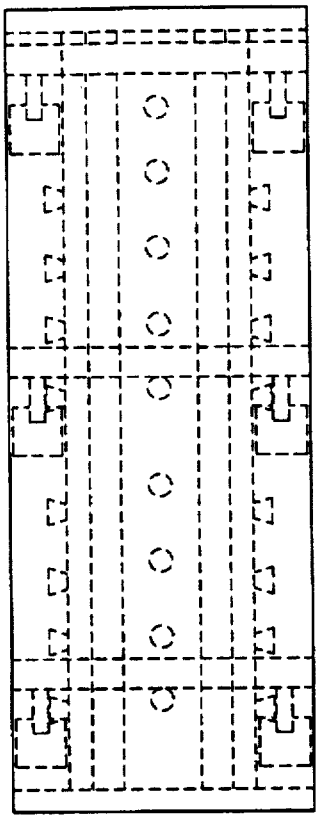
FIGS. 2A–2C are plan, front elevation, and side elevational views, respectively, of an air shower system constructed in accordance with a preferred embodiment of the present invention.
Figure 2B:
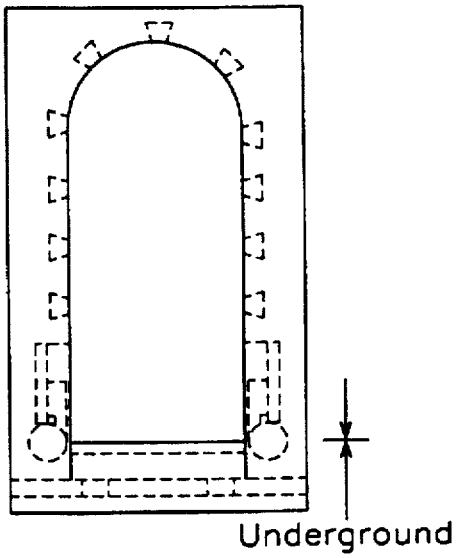
Figure 2C:
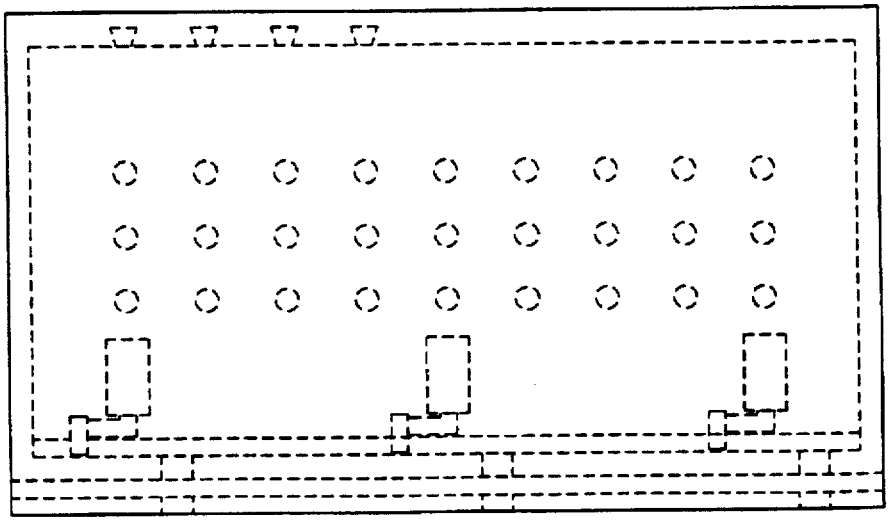
Figure 3:
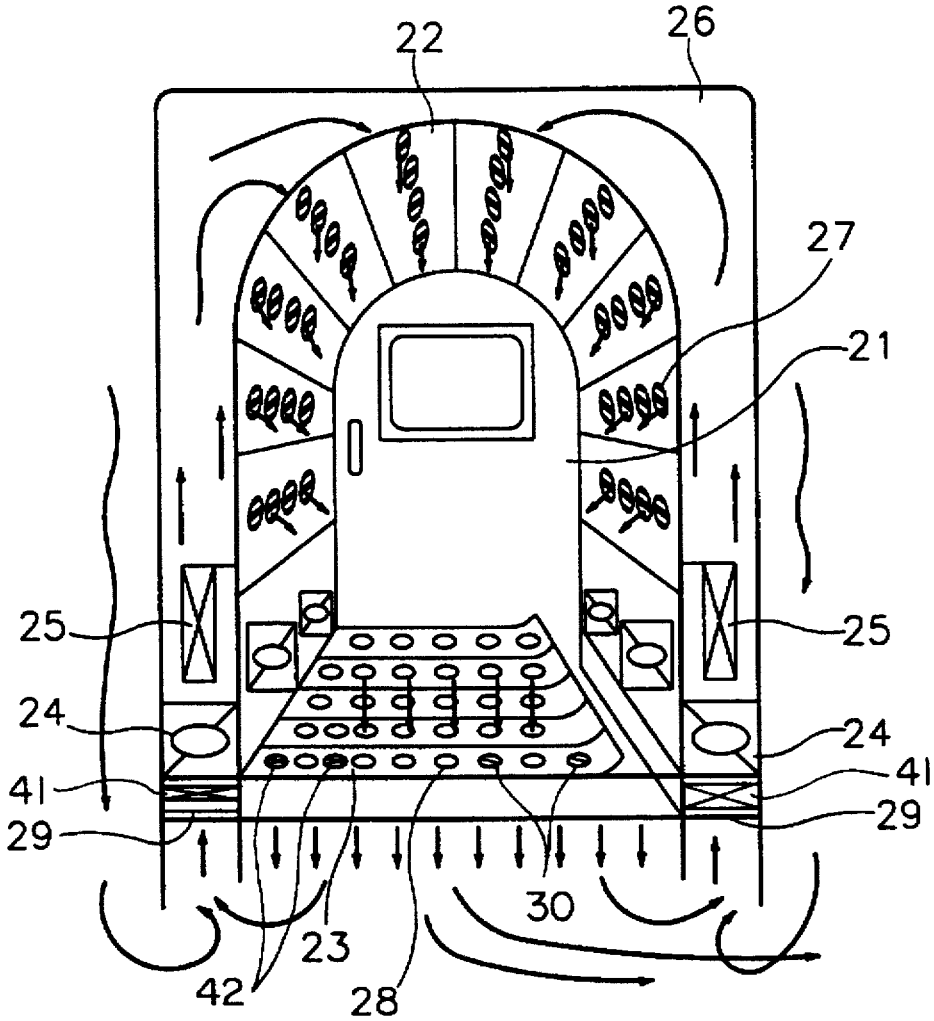
FIG. 3 is a schematic, perspective view of the internal structure of the air shower system depicted in FIGS. 2A–2C.

With reference now to FIGS. 2A–2B and 3, an air shower system constructed in accordance with a preferred embodiment of the present invention will now be described. With particular reference to FIG. 3, the air shower system includes an air shower room 21 having an arched ceiling 22 and sidewalls provided with a plurality of air supply nozzles 27, and a floor 23 provided with a plurality of air discharge holes 28 in fluid communication with an underground region (see FIG. 2B) which is in fluid communication with an underground region of a clean room (not shown). An air supply chamber 26 surrounds the ceiling 22 and sidewalls of the air shower room 21. A plurality of motor-driven blowers 24 are provided along the bottom surface of each of the respective portions of the air supply chamber 26 disposed alongside the opposite sidewalls of the air shower room 21, and filters 25 are provided above the blowers 24 (but below the air supply nozzles 27). Further, an air intake device(s) 29 is provided beneath the bottom surface of each of the respective portions of the air supply chamber 26 disposed alongside the opposite sidewalls of the air shower room 21. The air intake devices 29 provide a means for ingress of air from the underground region.

Air flow and circulation are indicated by the thick arrows in FIG. 3. Generally, air from the underground region enters the portions of the air supply chamber 26 disposed alongside the opposite sidewalls of the air supply room 21 through the air intake devices 29, and is forced upwardly through the filters 25 and thence, through the air supply nozzles 27 provided in the ceiling 22 and sidewalls of the air shower room 21, into the interior of the air shower room 21. The filters 25 are preferably hepa filters which have a particulate matter removal efficiency of 99.97%, so that the air entering the interior of the air shower room 21 via the air supply nozzles 27 is very well-filtered. The air supply nozzles 27 accelerate the air flow into the interior of the air shower room 21, to thereby dislodge loose particulate matter from any personnel (not shown) present in the air shower room 21. Additionally, a pre-filter 41 may be mounted within each of the air intake devices 29 in order to pre-filter the air entering into the air supply chamber 26, in order to maximize the efficiency of the filters 25.

The air containing the impurities removed from personnel within the air shower room 21 is discharged to the underground region via the air discharge holes 28 provided in the floor 23. Preferably, the air discharge holes 28 are provided with shutters 30 for regulating the diameter of the respective orifices or holes 28. The opening ratio (i.e., adjusted diameter/maximum diameter) of each of the air discharge holes 28 is preferably greater than 50%. Thus, the diameter of each of the air discharge holes 28 can be individually regulated, to thereby provide a greater degree of flexibility and control over the air flow patterns within and without the air shower room 21.

Because the underground regions of the air shower system and the clean room are in fluid communication, the air shower system of the present invention does not need to be equipped with a separate air conditioning system, as does the conventional air shower system.

Figure 4:
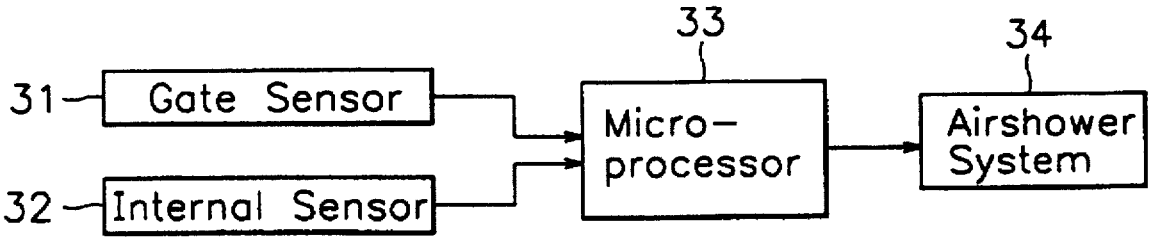
FIG. 4 is a block diagram of an automatic control system for the air shower system of the present invention.
Figure 5:
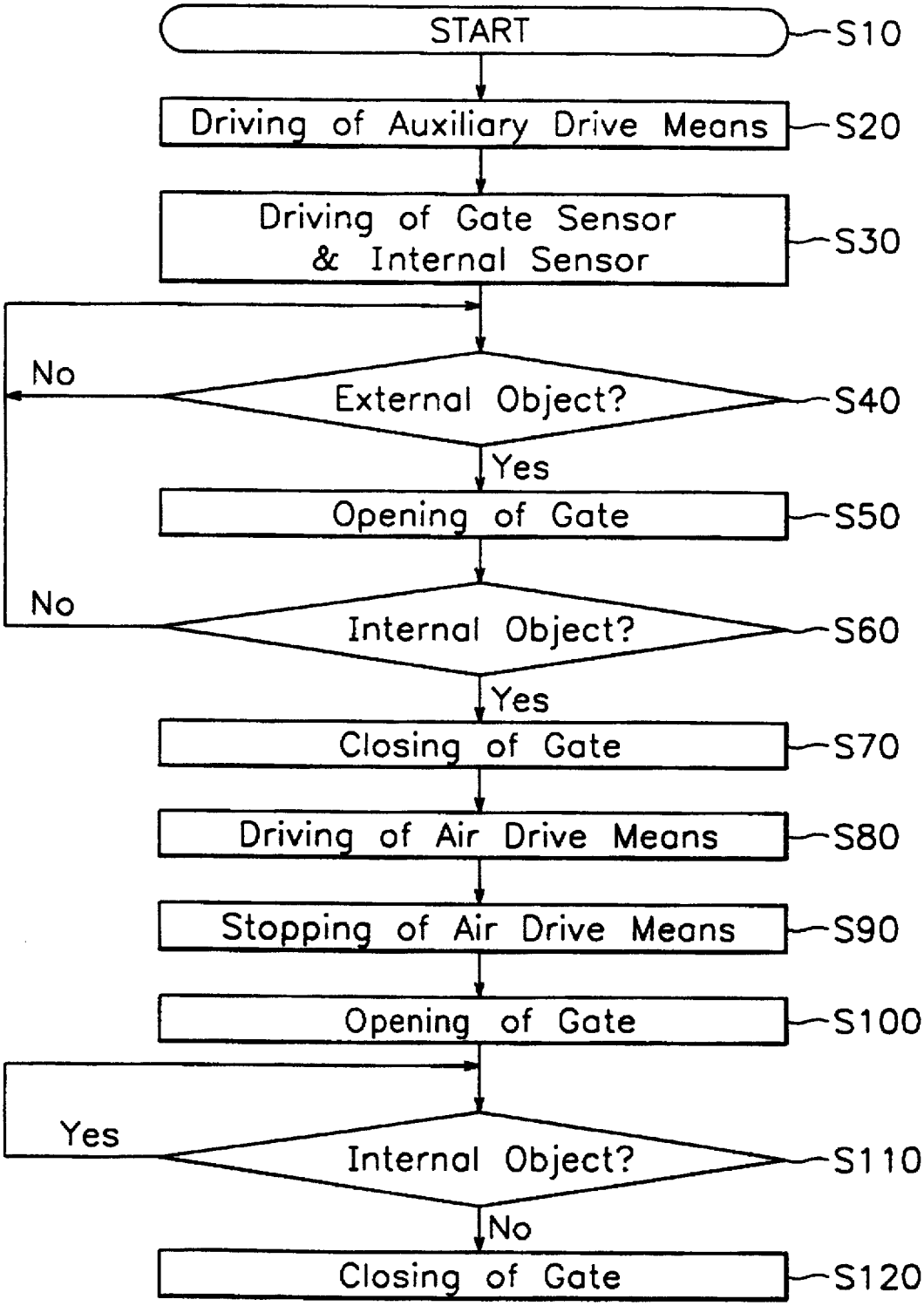
FIG. 5 is a flow chart illustrating the steps executed by the automatic control system depicted in FIG. 4; and, FIGS. 6A–6B are graphs depicting the time vs. particulate density characteristics of the air shower system of the conventional air shower system and of the present invention, respectively.
Figure 6A:
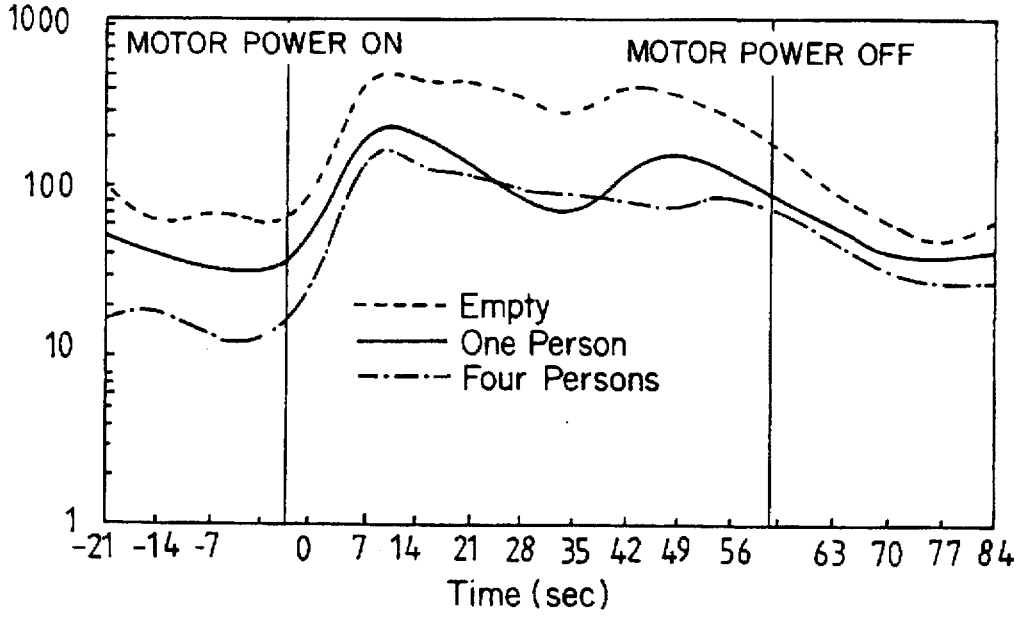
FIG. 6A (PRIOR ART)
Figure 6B:
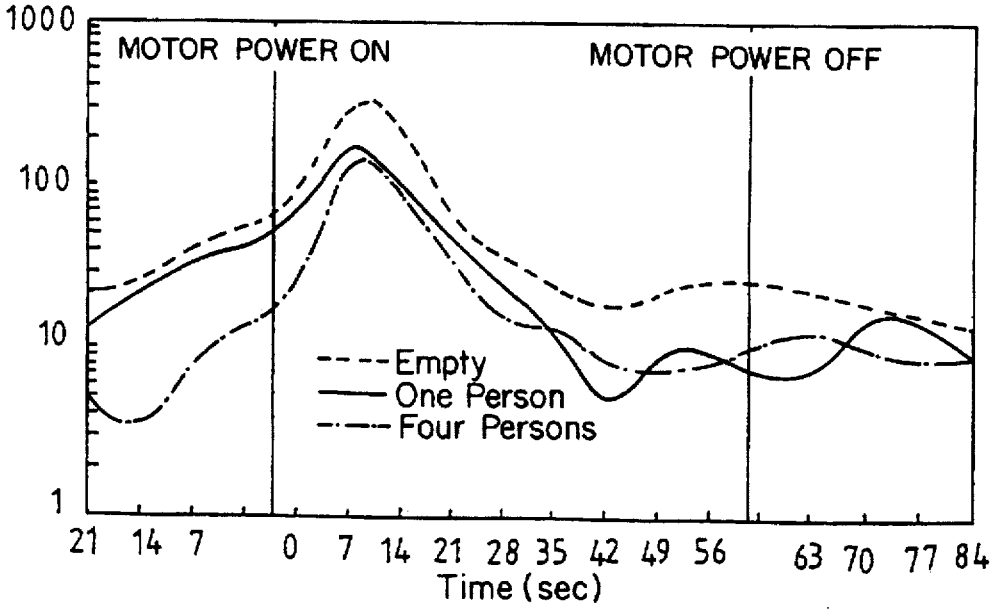

With reference now to FIGS. 4 and 5, an automatic control system for automatically controlling the operation of the above-described air shower system of the present invention will now be described. With particular reference to FIG. 4, the automatic control system includes a gate sensor 31 mounted on or near the entrance gate or door 40 of the air shower room 21, for detecting the approach of a person(s), an internal sensor 32 mounted within the air shower room 21 for detecting the presence of a person(s) within the air shower room 21, and a microprocessor 33 for processing output signals produced by the gate sensor 31 and the internal sensor 32, and for producing appropriate control signals for automatically controlling the operation of the air shower system 34, in accordance with an operating program executed by the microprocessor 33.

With reference now to FIG. 5, there can be seen a flow chart of the operating program executed by the microprocessor 33 for automatically controlling the operation of the air shower system of the present invention. In response to the automatic control system being activated (started) at step S10, the microprocessor 33, at step S20, activates an auxiliary drive means (not shown) which functions to circulate the air throughout the air shower system at an acceptable level. For example, the auxiliary drive means could include selected ones of the motor-driven blowers 24. Next, at step S30, the gate sensor 31 and internal sensor 32 are activated. At step S40, the microprocessor 33 decides whether or not an external object (i.e., an approaching person(s)) has been detected by the gate sensor 31. If so, then, at step S50, the microprocessor 33 produces a control signal to automatically open the gate or door 40 of the air shower room 21 in order to allow entry of such person(s). If no external object is detected by the gate sensor 31, then step S40 is continuously repeated, until such a detection is made. In other words, the microprocessor 33 continuously receives the output signal from the gate sensor 31. Until the output of the gate sensor 31 is at a logic high level, the microprocessor does not go on to the next step, i.e., step S50. At step S60, a determination is made by the microprocessor 33 as to whether or not an internal object (i.e., a person(s)) has entered into the interior of the air shower room 21. If the microprocessor 33 determines that a person(s) has in fact entered the air shower room 21, corresponding to a high logic level output of the internal sensor 32, then, at step S70, the microprocessor 33 outputs a control signal to automatically close the gate or door of the air shower room 21. If no internal object is detected by the internal sensor 32, then step S60 is continuously repeated, until such a detection is made. In other words, the microprocessor 33 continuously receives the output signal from the internal sensor 31. In response to the the gate being closed, the microprocessor 33, at step S80 produces a control signal(s) to automatically activate (turn on) the motor-driven blowers 24, to thereby blow a sufficient amount of air through the air supply nozzles 27 into the air shower room 21 to dislodge (blow off) particulate matter from the person(s) within the air shower room 21. After a predetermined period of time, at step S90, the microprocessor 33 produces a control signal(s) to automatically de-activate (turn off) the motor-driven blowers 24, and, at step S100, produces a control signal to re-open the gate to the air shower room 21. At step S110, the microprocessor 33 determines whether an internal object is still present within the air shower room 21 (by continuously monitoring the output of the internal sensor 32), and, if so, repeats this step until an internal object is no longer detected by the internal sensor 32. After it is detected that no internal object is within the air shower room 21, the microprocessor 33, at step S120, re-closes the gate to the air shower room 21.

Although a preferred embodiment of the present invention has been described in detail hereinabove, it should be clearly understood that many variations and/or modifications of the basic inventive concepts herein taught which may appear to those skilled in the art will still fall within the spirit and scope of the present invention as defined in the appended claims.

What is claimed is:

1. An air shower system, comprising:

an air shower room having a ceiling, sidewalls, and a floor;

an underground region in fluid communication with a clean room;

an air supply chamber surrounding said sidewalls and ceiling of said air shower room, said air supply chamber having an intake portion in fluid communication with said underground region;

a plurality of air supply nozzles provided in said sidewalls and ceiling of said air shower room;

a plurality of air discharge holes provided in said floor of said air shower room, said air discharge holes being in fluid communication with said underground region;

a plurality of filters provided in side portions of said air supply chamber disposed alongside said sidewalls of said air shower room; and, a plurality of blowers provided in said side portions of said air supply chamber for forcing air from said underground region through said filters and thence, through said air supply nozzles, into the interior of said air shower room, for blowing particulate matter off of a person situated in the interior of said shower room, said air containing said particulate matter being discharged through said air discharge holes into said underground region.

2. The air shower system as set forth in claim 1, wherein said plurality of blowers are disposed along a bottom surface of said side portions of said air supply chamber.

3. The air shower system as set forth in claim 2, further comprising prefiltering means disposed within said air intake portion of said air supply chamber.

4. The air shower system as set forth in claim 1, wherein each of said filters comprises a hepa filter.

5. The air shower system as set forth in claim 1, wherein each of said air discharge holes includes an adjustable shutter for regulating air flow through said air discharge holes.

6. The air shower system as set forth in claim 3, further comprising a plurality of additional filters provided in corresponding ones of said plurality of air discharge holes.

7. The air shower system as set forth in claim 1, further comprising a gate which can be opened for allowing entry of a person into the interior of said air shower room, and which can be closed during operation of said air shower system.

8. The air shower system as set forth in claim 7, further comprising a gate sensor. for detecting the approach of a person towards said gate, and for producing a first output signal when an approaching person is detected.

9. The air shower system as set forth in claim 8, further comprising an internal sensor for detecting the presence of a person in the interior of said air shower room, and for producing a second output signal when the presence of a person in the interior of said air shower room is detected.

10. The air shower system as set forth in claim 1, wherein said ceiling is arched.

11. The air shower system as set forth in claim 9, further comprising an auxiliary drive system for maintaining circulation of air throughout the air shower system during periods when no persons are present in the interior of said air shower room.

12. The air shower system as set forth in claim 9, further comprising a microprocessor which, in response to said first output signal, generates a first control signal for automatically opening said gate.

13. The air shower system as set forth in claim 12, wherein said microprocessor, in response to said second output signal, generates a second control signal for automatically closing said gate.

14. The air shower system as set forth in claim 13, wherein said microprocessor, in response to said gate being closed, generates a third control signal for automatically turning on said blowers.

15. The air shower system as set forth in claim 13, wherein said microprocessor, in response to said gate being closed, generates a third control signal for automatically turning on said blowers for a predetermined period of time.

16. The air shower system as set forth in claim 15, wherein said microprocessor, after said predetermined period of time, generates a fourth control signal for automatically turning off said blowers.

17. The air shower system as set forth in claim 16, wherein said microprocessor, after said predetermined period of time, generates a fourth control signal for automatically opening said gate.

18. The air shower system as set forth in claim 17, wherein, after said predetermined period of time, said microprocessor monitors said second output signal to determine whether a person is present within the interior of said air shower room, and, if not person is present, generates a fifth control signal for automatically closing said gate.

19. The air shower system as set forth in claim 1, further comprising a common air conditioning system which is capable of commonly supplying a regulated source of air to both said air shower system and said clean room.

20. The air shower system as set forth in claim 5, wherein said adjustable shutter is capable of being individually regulated to control air flow patterns within said air shower room.

* * * * *